United States Patent [19]

Cameron et al.

[11] Patent Number: 4,634,346

[45] Date of Patent: Jan. 6, 1987

[54] FAN GUARD ASSEMBLY

[75] Inventors: Thomas M. Cameron, Waukegan; Glenn M. Betlinski, Libertyville, both of Ill.

[73] Assignee: Dresser Industries, Inc., Dallas, Tex.

[21] Appl. No.: 756,218

[22] Filed: Jul. 18, 1985

[51] Int. Cl.[4] ..... F04B 39/10

[52] U.S. Cl. ..... 416/247 R; 416/247 A

[58] Field of Search ..... 416/247 R, 247 A; 415/121 G; 123/41.49

[56] References Cited

U.S. PATENT DOCUMENTS

| | | | |
|---|---|---|---|
| 1,747,627 | 2/1930 | Guth | 416/247 |
| 2,148,254 | 2/1939 | Bergstrom | 415/121 G |
| 2,325,913 | 8/1943 | McLemore | 416/247 |
| 2,345,516 | 3/1944 | Weber | 416/247 |
| 3,046,900 | 7/1962 | Pollak | 415/121 G |
| 3,204,546 | 9/1965 | Krell | 415/121 G |
| 3,262,638 | 7/1966 | Militello | 416/247 R |
| 4,120,615 | 10/1978 | Keem et al. | 415/121 G |
| 4,350,472 | 9/1982 | Morimoto | 415/121 G |

*Primary Examiner*—Robert E. Garrett
*Assistant Examiner*—John Kwon

[57] ABSTRACT

A fan guard assembly comprising a pair of mirror image plates, each of said plates having a plurality of perforations extending therethrough to define a plurality of air flow passages. The plates further include a flange-like surface extending radially outward from the top, bottom and the outboard side. The inboard sides of the plates are placed in overlapping relationship with respect to each other. The plates are joined together about the overlapped portions to form the fan guard assembly.

4 Claims, 3 Drawing Figures

FAN GUARD ASSEMBLY

BACKGROUND OF THE INVENTION

This invention relates to a fan guard assembly, and in particular, to a fan guard assembly particularly suitable for use to protect the fan used to cool the radiator of a construction vehicle.

Construction vehicles such as bulldozers, front-end loaders and the like, generally have air cooled radiators. A fan is utilized to provide the requisite air flow over the surface of the radiator for cooling purposes. A fan guard is generally provided to protect the fan. A fan guard provides a barrier to inadvertent intrusion of foreign material into the path of the fan blade. Although the guard is designed to prevent intrusion of foreign material, the fan guard must provide sufficient flow passages to minimize air flow restrictions to the blade. Further, the fan guard must have sufficient structural rigidity to withstand shocks and vibrations developed during normal operation of the construction vehicle.

Presently, fan guards on construction vehicles are made by welding pre-formed wires and/or bars together into a screen which follows the contour of the fan. Such fan guards are very expensive to manufacture and prone to failure at the many weld joints. Accordingly, it is an object of this invention to manufacture a fan guard that is reliable, less costly to produce, prevents intrusion of foreign material into the path of the fan blade, and minimizes air flow restrictions to the fan.

SUMMARY OF THE INVENTION

The foregoing objects of the invention are attained in a fan guard assembly comprising a pair of mirror image plates, each of said plates having a plurality of perforations extending therethrough to define a plurality of air flow passages and further including a flange-like surface extending radially outward from the top, bottom and the outboard side, the inboard sides of said plates being placed in overlapping relationship with respect to each other; and means extending through the overlapped portion of said plates for joining said pair of plates to form said fan guard assembly.

DESCRIPTION OF THE PREFERRED EMBODIMENT

Figure 2:
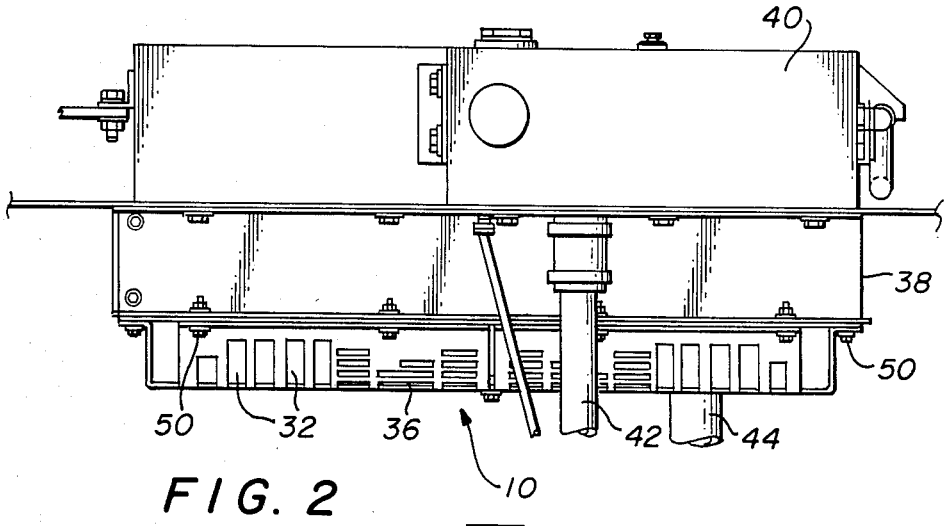
FIG. 2 is a plan view of the fan guard assembly and radiator illustrated in FIG. 1.
Figure 1:
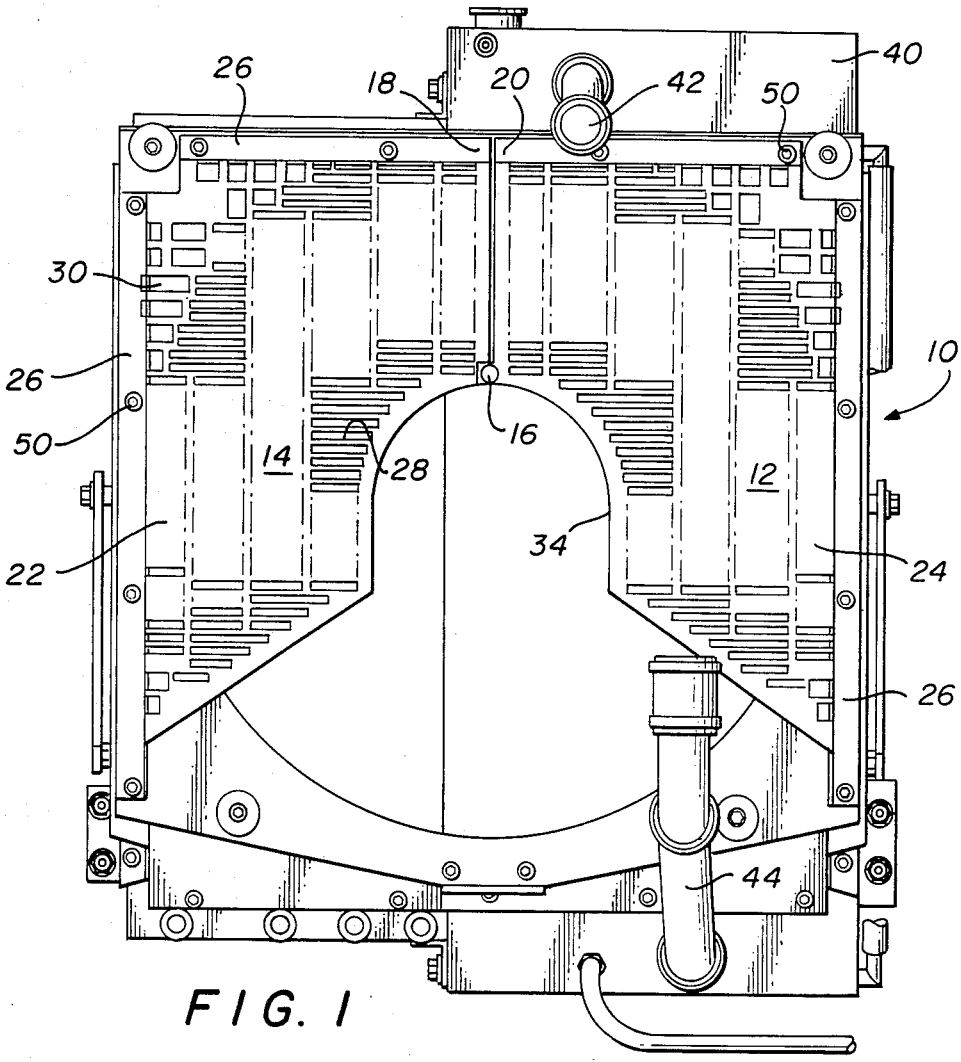
FIG. 1 is an elevational view of a fan guard assembly used to protect the fan employed to route air over a radiator of a construction vehicle.

Referring now to the drawing, there is illustrated a preferred embodiment of the present invention. In referring to the various figures of the drawing, like numerals shall refer to like parts.

The present invention relates to a fan guard assembly particularly suitable for use to protect the fan used to cool the radiator of a construction vehicle. Fan guard assembly 10 includes a pair of mirror image plates respectively 12 and 14. Each plate 12 and 14 has an inboard end respectively 20 and 18 and an outboard end respectively 24 and 22. The inboard ends are disposed in overlapping relationship. Suitable means, such as bolt 16, is utilized to join the overlapped portions of plates 12 and 14.

Each of the plates includes a plurality of generally rectangularly shaped perforations 28 extending therethrough. Although the perforations are configured in a rectangular shape, the perforations may be of circular or other polygon shapes. At the outboard ends 24, 22 of plates 12 and 14, the area of the perforations 30 increase in size as compared to the area of the perforations 28 adjacent the inboard sides 18, 20 of the plates.

Figure 3:
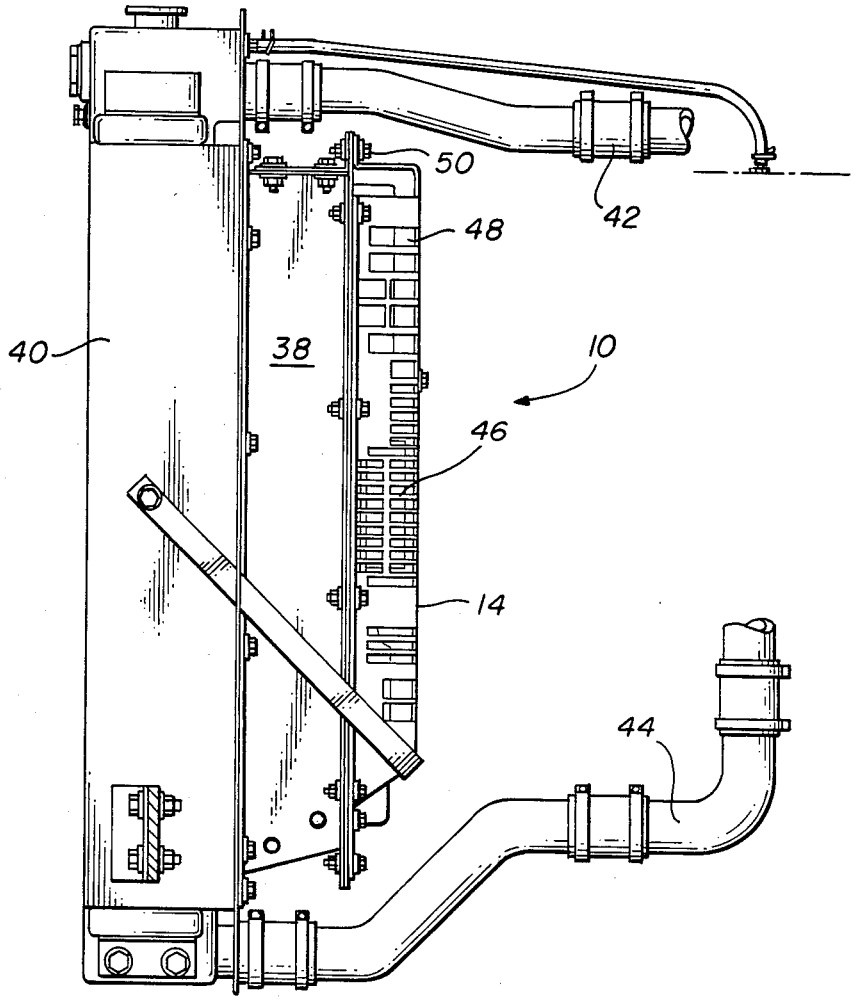
FIG. 3 is a side view of the fan guard assembly and radiator illustrated in FIG. 1.

A flange-like surface 26 extends radially outward from the top bottom and outboard side of each plate. Bolts 50 or other suitable joining means extend through the flange-like surface to connect the surface to a mating flange extending from a generally rectangularly shaped fan shroud 38. As illustrated in FIG. 3, the side of plate 14 includes a plurality of perforations 46, 48. It will be observed that the area of perforations 48 is greater than the area of perforations 46. The area of the perforations increase at the upper and lower extremities of the plate as compared to the perforations disposed about the horizontal center-line. Likewise, as illustrated in FIG. 2, the top of plates 12, 14 include perforations 36 and 32. Perforations 32 are located radially outward relative to perforations 36; the area of perforations 32 is greater than the area of perforations 36.

Fan guard assembly 10 is utilized to protect the blades of a propeller fan from debris or other foreign particles which might otherwise intrude into the path of rotation of the fan blades during normal operation of the construction vehicle. The fan (not shown) rotates within fan shroud 38 in a manner well-known to those skilled in the art. The fan is mounted on a shaft extending through oblong opening 34 defined by the inner walls of plates 12 and 14.

Fan shroud 38 in turn is connected to radiator 40. Radiator 40 includes a fluid inlet 42 and a fluid outlet 44. Air is routed via the fan over the surface of radiator 40 in heat transfer relation with the fluid delivered through fluid inlet 42.

Heretofore, fan guards employed on construction vehicles have been made by welding pre-formed wires and/or bars together into a screen which follows the contour of the fan. The prior art fan guards were relatively expensive to manufacture and prone to failure at the many weld joints.

Fan guard 10 of the present invention is manufactured from two identical blanks of metal, which are then identically perforated. After perforation, one of the blanks is bent to form a right-hand plate and the second blank is bent to form a left-hand plate. The two plates are thence mirror images of each other.

The plates are perforated to provide the necessary fluid flow openings for the air routed over the radiator via the fan. To minimize air flow restrictions, openings 30, 32 and 48 which are located generally along the outboard end of the plates, are of greater area than the perforations located about the inboard side of the plates, as the inboard perforations are located in closer proximity to the fan than are the outboard perforations.

By constructing the fan guard in the manner described, the guard is less costly to produce, minimizes air flow restrictions, and is more reliable since the welded joints are generally eliminated.

Although guard 10 has been manufactured from a pair of plates, primarily for ease of access to the fan located therebehind, it is within the broad scope of the invention to form the guard from a single blank, perforate the blank to form the fluid flow openings, then bend the blank to form the final guard.

While a preferred embodiment of the present invention has been described and illustrated, the invention should not be limited thereto, but may be otherwise embodied within the scope of the following claims.

The embodiments of the invention in which an exclusive property or privilege is claimed are defined as follows:

1. A guard assembly for a fan of a motor vehicle comprising:

a plate having a top, bottom and sides, said plate including a top wall, a bottom wall and side walls for enclosing the fan, said walls being integrally formed with said plate and being generally perpendicularly disposed to said plate at said top, bottom and sides, respectively;

said plate having a plurality of perforations extending therethrough to define a plurality of air flow passages, wherein said plurality of perforations generally increase in area at the top, bottom and sides of said plate as compared to the area of said perforations at the center of said plate, and wherein the area between said perforations generally increase in area at the top, bottom and sides of said plate as compared to the area between said perforations at the center of said plate; and said walls having a plurality of perforations extending therethrough to define a plurality of air flow passages, wherein said plurality of perforations generally increase in area at the ends of said walls as compared to the area of said perforations at the center of said walls and the area between said perforations generally increase in area at the ends of said walls as compared to the area between said perforations at the center of said walls.

2. The guard assembly of claim 1 wherein said perforations are generally polygon-like in configuration.

3. The guard assembly of claim 2 wherein said polygon-like perforations are generally rectangular in configuration.

4. The guard assembly of claim 1 wherein ones of said plurality of perforations extending through said plate are disposed in alignment with ones of said plurality of perforations extending through said walls.

* * * * *